US007300235B2

(12) United States Patent
Gimelfarb et al.

(10) Patent No.: US 7,300,235 B2
(45) Date of Patent: Nov. 27, 2007

(54) KEY DUPLICATING MACHINE

(75) Inventors: Grigory Gimelfarb, Forest Hills, NY (US); Fred Lang, Brooklyn, NY (US); George Buchinger, Brooklyn, NY (US)

(73) Assignee: Jet Hardware Manufacturing Corporation, Brooklyn, NY (US)

( * ) Notice: Subject to any disclaimer, the term of this patent is extended or adjusted under 35 U.S.C. 154(b) by 175 days.

(21) Appl. No.: 11/295,687

(22) Filed: Dec. 5, 2005

(65) Prior Publication Data

US 2006/0147289 A1 Jul. 6, 2006

Related U.S. Application Data

(60) Provisional application No. 60/633,259, filed on Dec. 3, 2004.

(51) Int. Cl.
*B23D 4/02* (2006.01)
*B23C 3/35* (2006.01)

(52) U.S. Cl. ..... 409/277; 409/81; 409/280; 76/110

(58) Field of Classification Search ..... 409/277, 409/278, 279, 280, 276, 281, 286, 287, 81, 409/82, 83, 125, 126, 207, 208, 210, 214; 76/110, 79.5
See application file for complete search history.

(56) References Cited

U.S. PATENT DOCUMENTS 1,746,499 A * 2/1930 Roos ..... 409/83
1,848,046 A * 3/1932 Caron ..... 409/81
5,128,531 A * 7/1992 Fadel ..... 409/81
5,496,138 A * 3/1996 Drori ..... 409/81
5,660,509 A * 8/1997 Cole et al. ..... 409/81
5,833,406 A * 11/1998 Chies et al. ..... 409/81
5,951,218 A * 9/1999 Wu ..... 409/81
5,964,554 A * 10/1999 Drori ..... 409/81
5,997,224 A * 12/1999 Beauregard et al. ..... 409/81
6,033,164 A * 3/2000 Hoffman et al. ..... 409/81

* cited by examiner

*Primary Examiner*—Dana Ross
(74) *Attorney, Agent, or Firm*—Darby & Darby

(57) ABSTRACT

A portable, mechanically operated, key-duplicating machine that relies on a punch-cutting system that selectively punches out the particular notches or "bittings" of a key blank in response to the details of an adjacent and aligned master key. The duplicating machine comprises a frame having cutting end and an alignment end. The frame defines a longitudinal axis. A carriage is movable along the longitudinal axis and includes a transverse axis. A key clamping assembly has a first key clamp for holding the key blank and a second key clamp for holding the master key. The key assembly is selectively slidable along the transverse axis. A cutting assembly is located at the cutting end and includes a punch-type cutter pin that is adapted to selectively cut pre-shaped notches from the held key blank. The cutter pin includes a guide section that aligns with the notch-profile of the held master key. The key clamping assembly is rotatable about the transverse axis and with respect to the carriage so that the mounted keys face either the cutting end or the alignment end of the frame.

8 Claims, 8 Drawing Sheets

FIG. 5
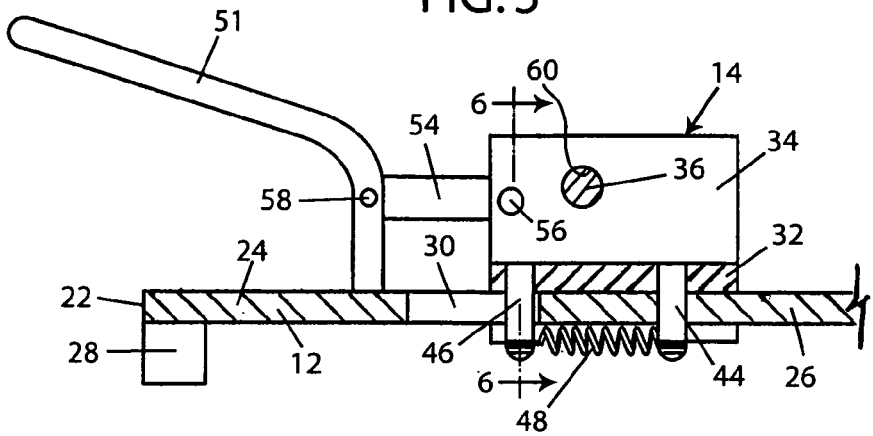
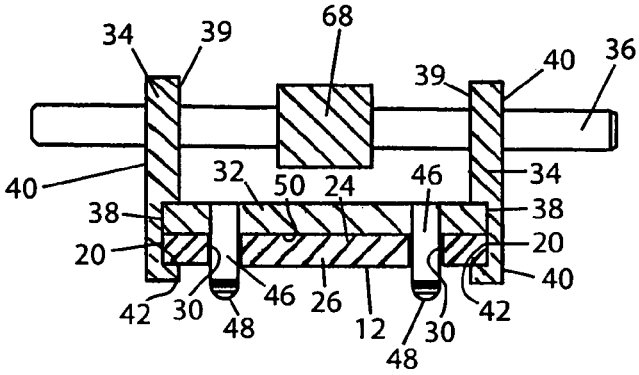
FIG. 6
FIG. 7
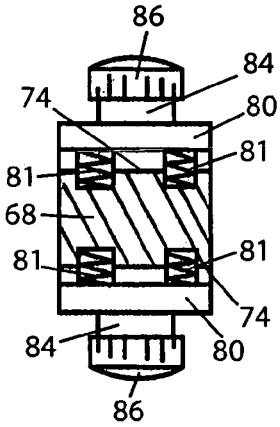
FIG. 8
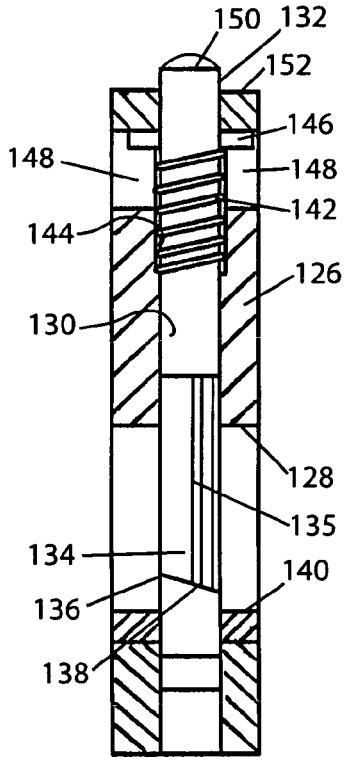

KEY DUPLICATING MACHINE

BACKGROUND OF THE INVENTION

1) Field of the Invention

The present invention relates to a key-duplicating machine, and more particularly to an improved key-duplicating machine of the type that uses a punch-type cutter and requires no power supply.

2) Description of the Prior Art

There are two basic types of key cutting machines—duplicating key-cutting machines and code-cutting key-cutting machines.

A code cutting type machine includes a variety of cutting elements, each of which may be adjusted to control depth, relative position along the key blank, and angle of cut. The adjustment is digitized and follows a specific code, according to the manufacture of the key and lock, the type of lock, the type of key, and the specific shape of the key notches (the key combination). Code books are published listing the longitudinal spacing of the notches along the blade of the key blank and the depth increments of the notches for keys which are utilized to open substantially all types of locks. By following the specification in the code books, a locksmith can manually cut the proper notches in a key blank to duplicate a lost or misplaced key.

The standard equipment used by locksmiths is a duplicating machine which typically has a rotary filing or milling cutter for cutting key blanks. A key duplicating machine has three basic parts—a pair of vises coupled together and movable in unison, a key guide, and a cutter wheel. One vise holds the original or master key and the other vide holds a key blank. The key guide follows the profile of the original key and moves-the pair of vises together. As the key guide moves along the profile of the master key, the key blank moves correspondingly against the spinning cutter wheel so that the cutter wheel notches the key blank to the desired depth and shape as directed by the movements of the key guide. This arrangement is similar to machines called pantographs where a guide component is mechanically linked to a cutting assembly and thereby controls relative movement of the cutter, as desired.

Typical key duplicating machines operate on 110-volt AC or 12-volt DC current and are sometimes carried in a van or service truck, but are really not considered portable owing to their power requirements.

Such key-duplicating machines are useful for creating a key when an already cut key is available to be used as a guide. Where such a master (or any) key is unavailable, a code key-cutting machine can be used.

Both of these key-cutting systems have their benefits and disadvantages. The present invention is directed to improvements of the key-duplicating type key cutters.

Current duplicators rely on the controlled displacement of a rotating cutting wheel along a key-blank to cut the key blank according to the detail of an adjacent key-master which is used as a guide. Rotating the cutting wheel requires an electric motor and therefore requires a power supply, either batteries or a power cord, and an appropriate source of line voltage. This either makes the machine portable, but bulky and heavy, owing to the required batteries, or not portable in that line voltage is required.

There are several portable key-cutting machines disclosed in the prior art; however, these machines are of the code-cutting type and therefore require the specific code of the particular key to set the device prior to cutting the key blank.

These devices are not able to cut a key blank using an already cut key as a guide (i.e., a key-duplicator key cutter).

Furthermore, regardless of the type of key-cutting machine used, each type and brand of key uses a specific bitting angle and therefore requires that the particular cutting element be capable of repeating that particular angle of cut. Some of the popular cutting angels include 72°, 78°, 84°, 86°, 87°, 90°, 100°, 104°, and 110° as measured from the cutting plane. This requires that the rotating cutting wheel be replaced prior to cutting the particular key. Replacement of this cutting wheel may require tools and time, which would likely make the key-duplicating process inefficient and inconvenient.

Other problems regarding portable code-type key-cutting machines include difficulty and awkwardness in operating the device which typically rely on pistol-style actuation and can require substantial strength to operate.

SUMMARY OF THE INVENTION

The invention provides a portable, mechanically operated, key-duplicating machine that relies on a punch-cutting system that selectively punches out the particular notches or "bittings" of a key blank in response to the details of an adjacent and aligned master key. The duplicating machine for cutting a key blank from the notch-profile of a master key comprises a frame having a cutting end and an alignment end. The frame defines a longitudinal axis. A carriage is included and is movable along the longitudinal axis and defines a transverse axis. A key clamping assembly has a first key clamp for holding the key blank and a second key clamp for holding the master key. The key clamping assembly is selectively slidable along the transverse axis. A cutter assembly is located at the cutting end and includes a punch-type cutter pin that is adapted to selectively cut pre-shaped notches from the held key blank. The cutter pin includes a guide section that aligns with the notch-profile of the held master key. The key clamping assembly is rotatable about the transverse axis and with respect to the carriage so that that mounted keys simultaneously face either the cutting end or the alignment end of the frame.

BRIEF DESCRIPTION OF THE DRAWINGS

FIG. 5 is a section view of a portion of the key-duplicating machine of FIG. 1, taken along the line 5-5 of FIG. 2 and showing detail of a slider block assembly;

FIG. 6 is a section view of a portion of the key-duplicating machine of FIG. 1, taken along the line 6-6 of FIG. 5, showing details of the slider block assembly;

FIG. 7 is a section view of a key clamp assembly taken along the line 7-7 of FIG. 4;

FIG. 8 is a section view of a portion of the key-duplicating machine of FIG. 1, taken along the line 8-8 of FIG. 4 and showing details of a broach-cutter assembly;

DETAILED DESCRIPTION OF THE PREFERRED EMBODIMENTS

This invention is a key-duplicating machine that is completely manual in operation and requires no power supply to operate. The machine is quick and easy to use, and can easily cut a key blank following the contours of an already cut key (a key master).

Figure 1:
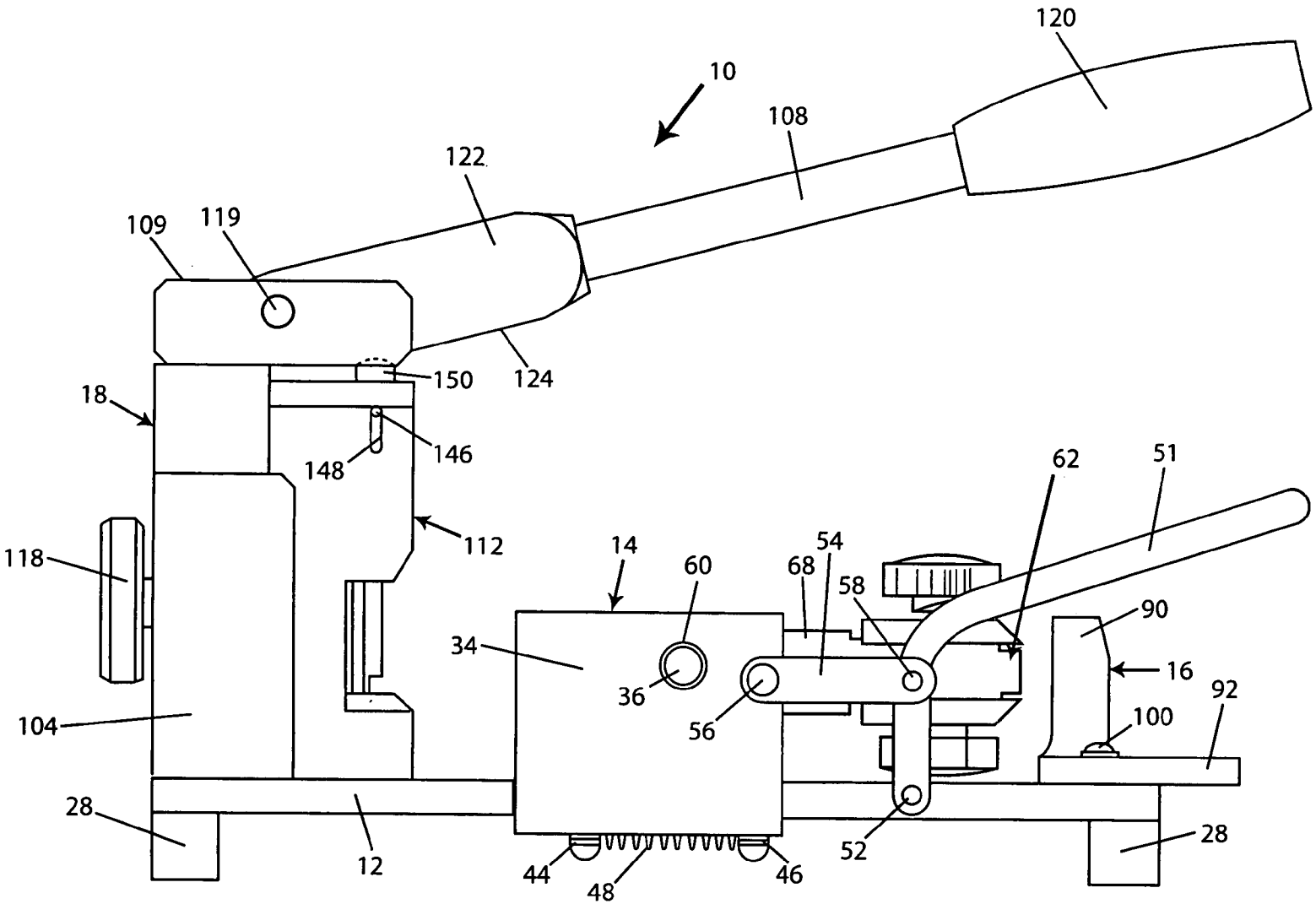
FIG. 1 is a side elevation view of a key-duplicating machine according to a preferred embodiment of the invention, showing a plunger handle in an operative position.

Referring to FIG. 1, a key-duplicating machine 10 is shown including a flat base plate 12, a slider block 14, a reference set-up block 16, and cutting block assembly 18. The slider block 14 is slidably mounted to base plate 12 between a set-up position and a cutting position, as described in greater detail below.

Referring to FIGS. 2, 4, 5, 6, and 11, base plate 12 is generally rectangular in shape and includes two long sides 20, two relatively shorter ends 22, an upper surface 24, and lower surface 26. Base plate 12 further includes contact feet 28 which are secured to the lower surface 26 of base plate 12, preferably at each corner. Collectively, feet 28 are used to raise the machine 10 above a surface making room for the components of the machine 10 to operate correctly, as described below, and to ensure that the machine 10 remains stable on a surface during use.

Base plate 12 includes two elongated slots 30 formed parallel to each other and parallel to long sides 20 of base plate 12. The exact location, size and shape of slots 30 are not critical for the present invention to function properly. Slots 30 offer a preferred way to control the limits of movement of slider lock 14 with respect to base plate 12, and to introduce a spring bias to the movement of slider block 14, as described below.

Slider block 14 includes a horizontal sliding plate 32, two vertical slide support plates 34, and a transverse support pin 36. Sliding plate 32 includes two side edges 38, each of which are generally parallel to long sides 20 of base plate 12, and secured to the side support plates 34 by appropriate fasteners such as machine bolts (not shown).

Each vertical slide support plate 34 defines an inside surface 39 and an outer surface 40. A channel 42 (see FIG. 6) is provided within inner surface 39 of each vertical side plate 34. Each channel 42 is formed parallel to horizontal sliding plate 32 and is sized and shaped to receive both a respective side edge 38 of sliding plate 32 and a respective long side 20 of base plate 12.

The arrangement is such that when sliding plate 32 is secured within the channels 42 of each vertical side plate 34, the space provided within each channel 42 is sufficient to provide a snug-fit sliding engagement with each long side 20 of base plate 12, as shown in section view in FIG. 6. To this end, the width of sliding plate 32 is equal to the width of base plate 12 so that side plates 34 secured to side edges 38 of sliding plate 32 slidingly engage the long sides 20 of base plate 12. With this arrangement, slider block 14 can be slid along base plate 12, as described below, while maintaining a high tolerance fit relative to the base plate 12 and cutting block assembly 18, so that the cutting system will ensure high-tolerance cuts to keys blanks.

As shown in FIGS. 5 and 6, adjacent to each slot 30 of base plate 12, a vertically disposed anchor pin 44 is secured to the lower surface 26 of base plate 12. A vertically disposed spring pin 46 is secured to a lower surface 50 of sliding plate 32 of slider block 14 and positioned within each slot (two pins, as shown in FIG. 6). Each spring pin 46 is sized and shaped to snugly slide within each respective slot 30 and help guide slider block 14 as it moves along the upper surface of base plate 12 and effectively controls the range of movement of slider block 14 (as defined by the length of the slots 30).

A spring 48 is attached between each spring pin 46 and its respective anchor pin 44 so that the two springs 48 remain parallel to each other and to long sides 20. Springs 48 effectively introduce a spring bias to slider block 14 with respect to base plate 12 so that slider block is biased toward cutting block assembly 18, as described below.

Figure 9:
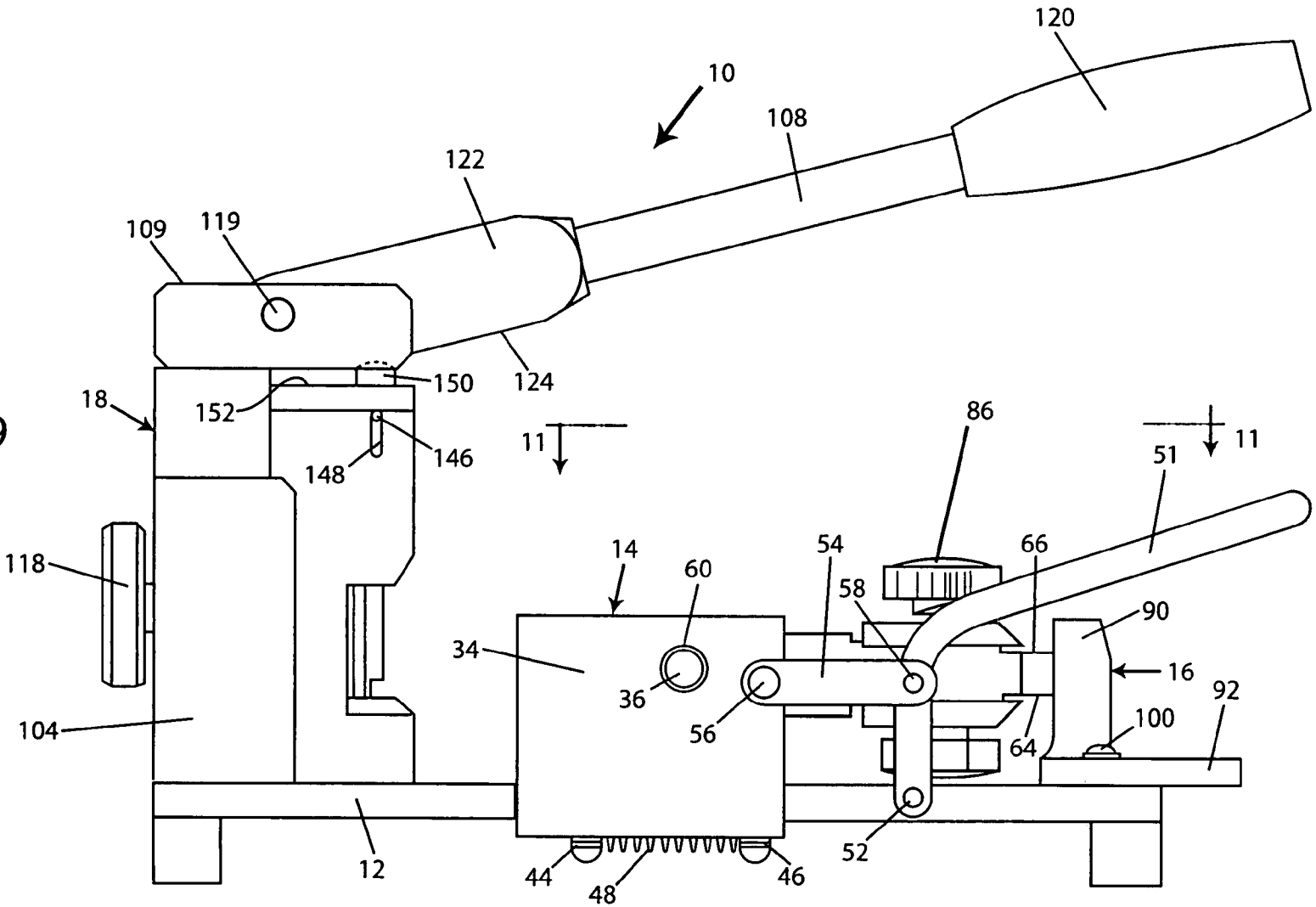
FIG. 9 is a side view of the key-duplicating machine of FIG. 1, showing the key-clamp assembly in an alignment and setup position and holding two keys against an alignment block.
Figure 10:
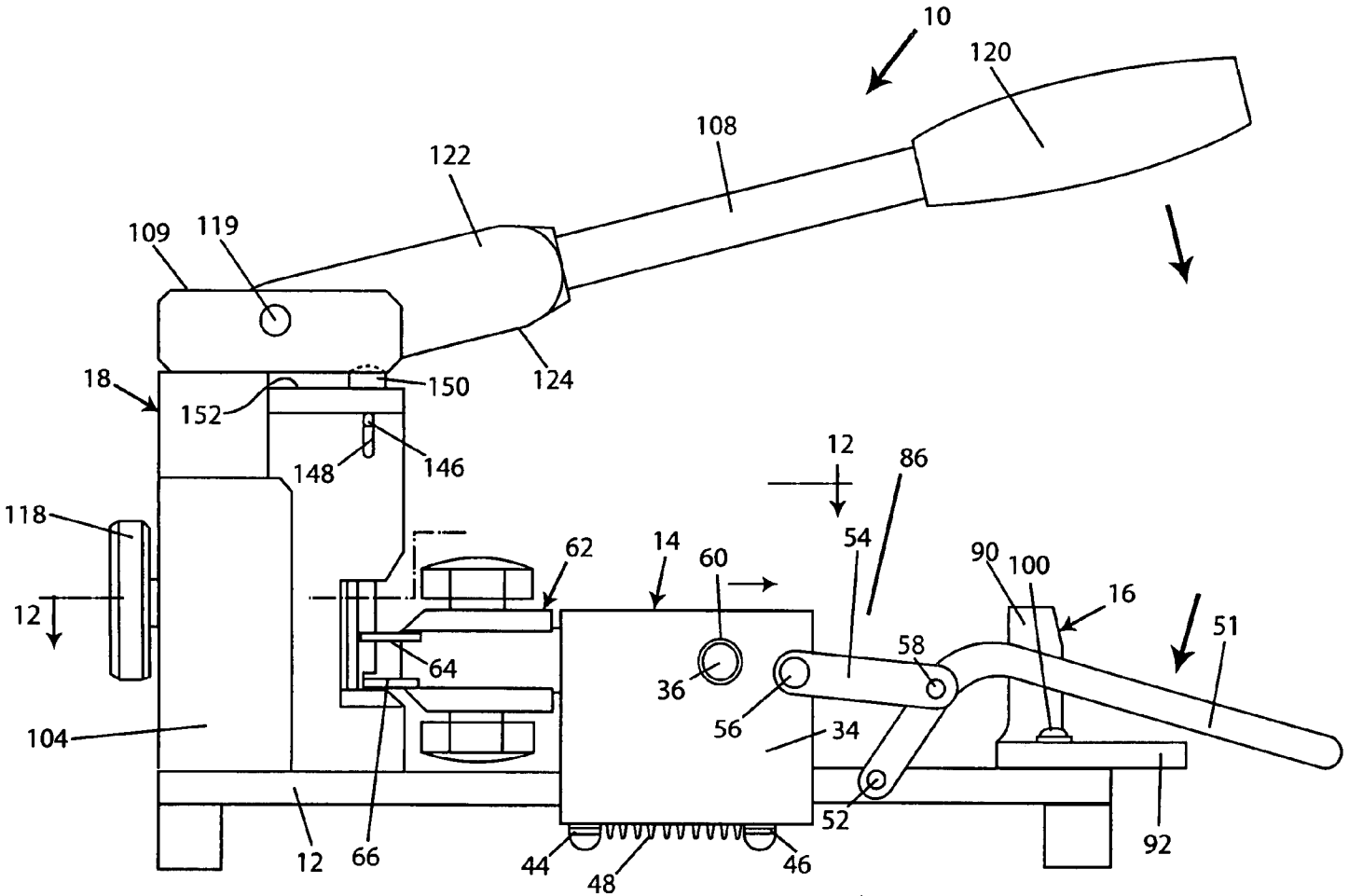
FIG. 10 is a side view of the key-duplicating machine of FIG. 1 showing the key-clamp assembly located in a cutting position.
Figure 11:
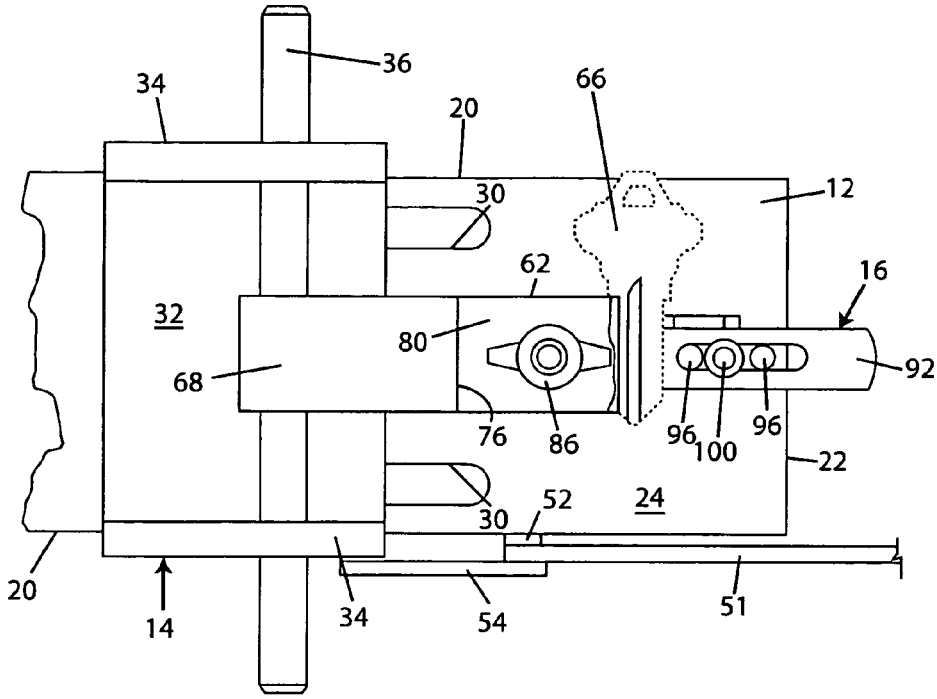
FIG. 11 is a top plan view of a portion of the key-duplicating machine of FIG. 1 taken along the line 11-11 of FIG. 9 showing details of the key-clamp assembly located in the alignment and setup position.

As shown in FIGS. 1, 2, 9 and 10, a key-movement handle 51 is provided, pivotally attached to a portion of base plate 12 at a pivot point 52 between a fully raised position, shown in FIG. 9, and a fully depressed position, shown in FIG. 10. Movement of key-movement handle 51 about pivot point 52 causes clamped keys (not yet discussed) to move within a horizontal plane which is parallel to the upper surface 24 of base plate 12.

A link arm 54 is pivotally attached at a pivot point 56 to a portion of slider block 14 and also at another pivot point 58 to a portion of key-movement handle 51 so that angular displacement of key-movement handle 51 about pivot point 52 translates into linear movement of slider block 14 along base plate 12. When slider block 14 moves linearly along the upper surface 24 of base plate 12, its range of motion is limited by the length of slots 30 and, as mentioned above, block 14 is always biased towards the cutting block assembly 18 by springs 48.

Transverse support pin 36 is supported in a bore 60 located within each vertical side support plate 34. Support pin 36 is preferably slidably-fit into bores 60 so that pin 36 may freely slide within bores 60 with respect to side support plates 34.

Figure 4:
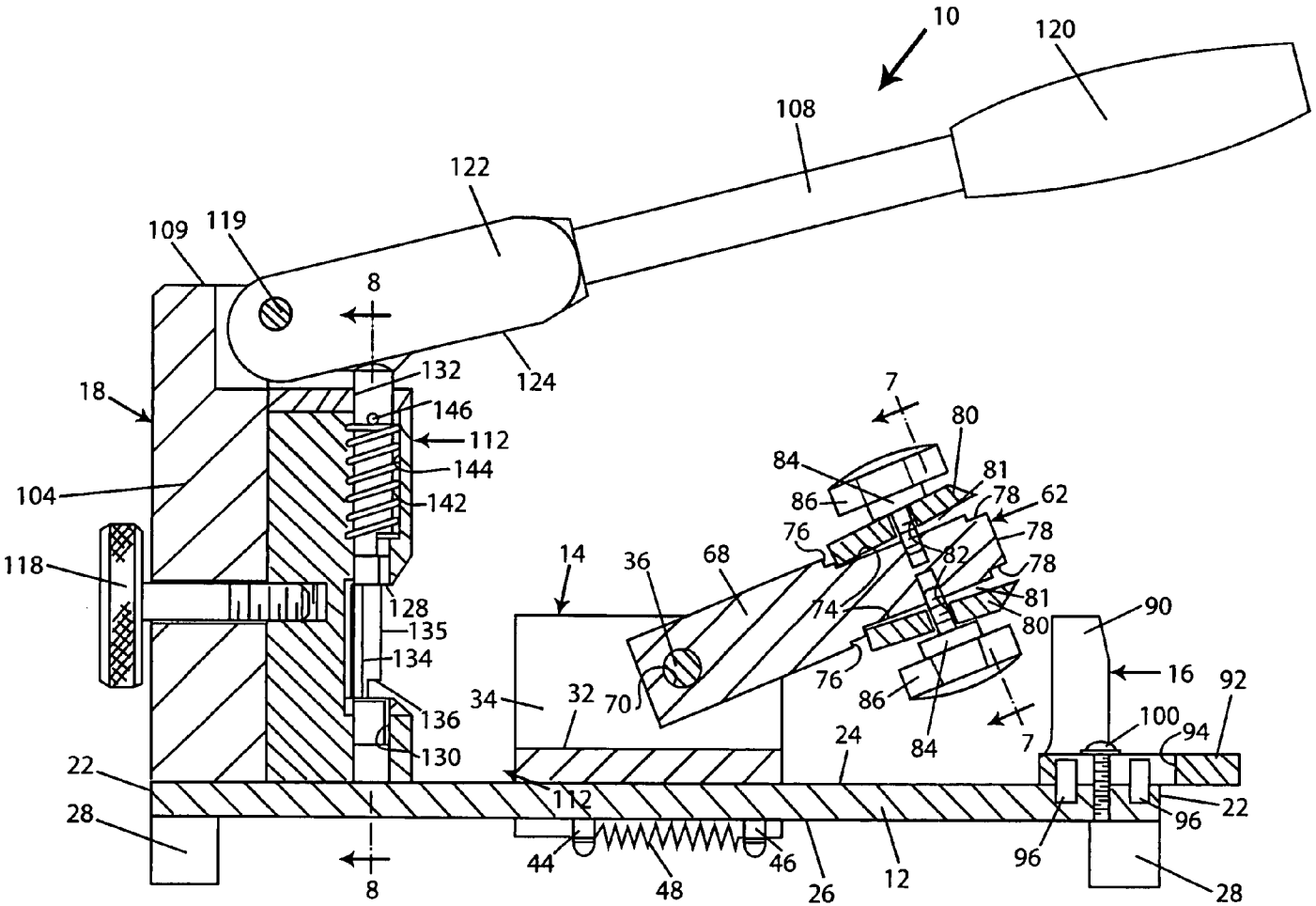
FIG. 4 is a section view of the key-duplicating machine of FIG. 1, taken along the line 4-4 of FIG. 2.

Fixed to support pin 36, between side support plates 34, is a key-clamping assembly 62 which is shown in FIGS. 4, 6, 7, 11, and 12. Key-clamping assembly 62 is used to hold both a key master 64 and a key blank 66 in perfect alignment with respect to each other. Key clamping assembly 62 includes a clamp block 68, which includes a bore 70 at one end that is sized and shaped to press-fit onto support pin 36. Key master 64 and key blank 66 are both secured to an opposing clamp end 72 of clamp block 68. Key clamping assembly 62 is generally rectangular and includes two opposing flat surfaces 74 at end 75. Each flat surface 74 includes a first stepped surface 76 and a channel 78. Located within each stepped surface 76 is a clamping plate 80. Each clamping plate 80 is secured to within each respective stepped surface 76 by a bore 82 and a fastener 84. As shown in FIG. 4, each fastener 84 includes an easy to operate knob 86 so that the clamping assembly may be operated by the operator without requiring tools. Appropriate springs 81 are used to bias each clamping plate 80 in an open position so that each respective channel 78 remains open and accessible for insertion of a key 64, 66.

Each of the two channels 78 is formed along the outer edge 75 of clamp block 68 and is sized and shaped to receive a portion of either the master key 64 or the key blank 66 so that a portion of either respective key 64, 66 extends beyond its respective channel 78. In this arrangement, a user can rotate knob 86 of each fastener 84 to tighten down each respective clamping plate onto the extended portion of each respective key located in its channel 78. The purpose of clamp block 68 is to allow both master key 64 and key blank 66 to be held along a non-cutting edge of each key thereby exposing an edge of the key blank 66 to be cut, and the already cut edge detail of the master key 64.

Clamp block 68 with keys 64, 66 in place in their respective channels 78 is pivotable about support pin 36 between a set up position (shown in FIGS. 1 and 9), wherein keys 64, 66 are both directed towards the rear of the base plate 12 and reference set-up block 16, and a cutting position (shown in FIG. 10), wherein keys 64, 66 face the front of base plate 12 and cutting block assembly 18. The swinging action of clamp block 68, is shown in FIG. 4.

Referring to FIGS. 1, 2, 4 and 11, reference set-up block 16 includes an alignment post which has a vertical portion 90 and a base portion 92. Base portion 92 of the alignment post includes a slot 94 which is parallel to the long side 20 of base plate 12. Two alignment pins 96 are affixed within base plate 12 so that they extend above upper surface 24. The pins are sized and shaped to fit snugly within slot 94 so that set-up block 16 may be selectively displaced between a rear position and a forward position. An appropriate fastener 100 is positioned within slot 94 and threaded within a threaded bore 102 located within base plate 12 so that set-up block 16 may be secured at a particular desired location between its range of movement, as shown in FIG. 4.

Figure 2:
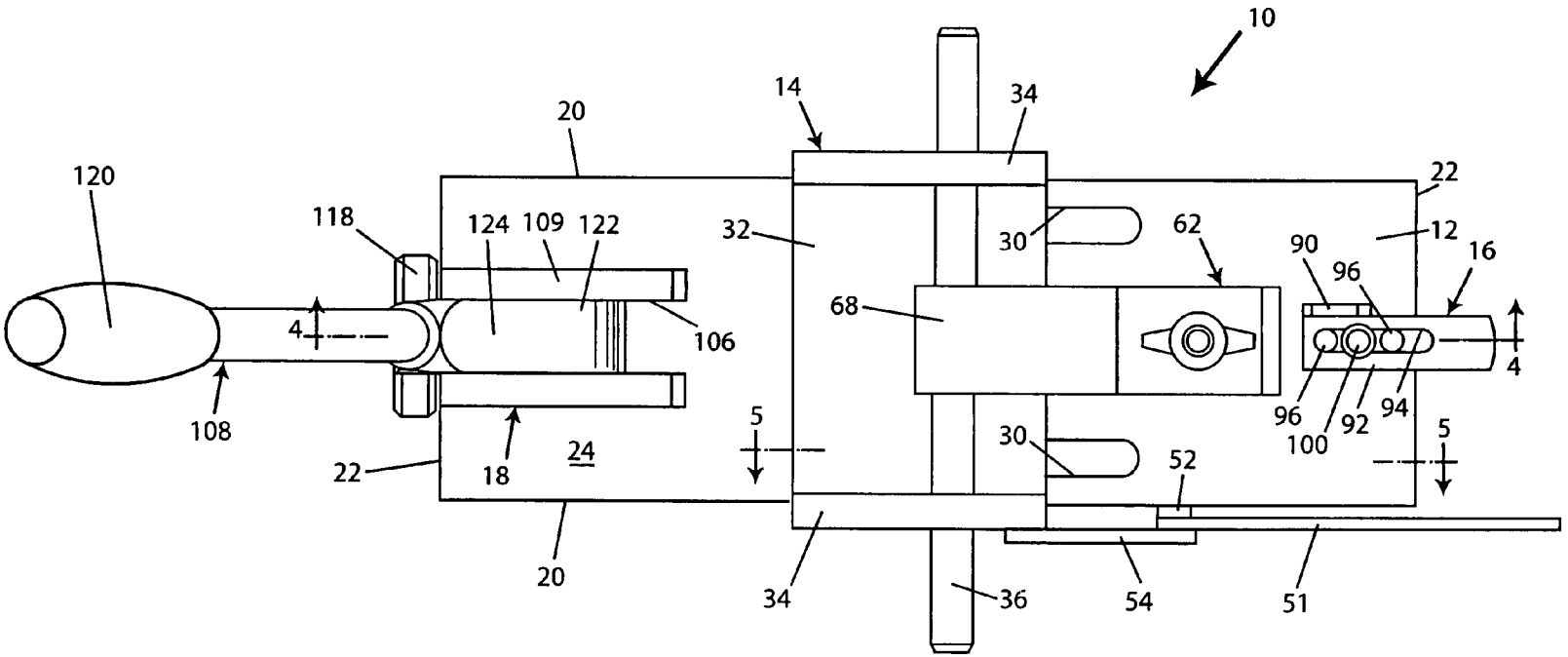
FIG. 2 is a top plan view of the key-duplicating machine of FIG. 1, with the plunger handle in a cartridge-replacement position.
Figure 3:
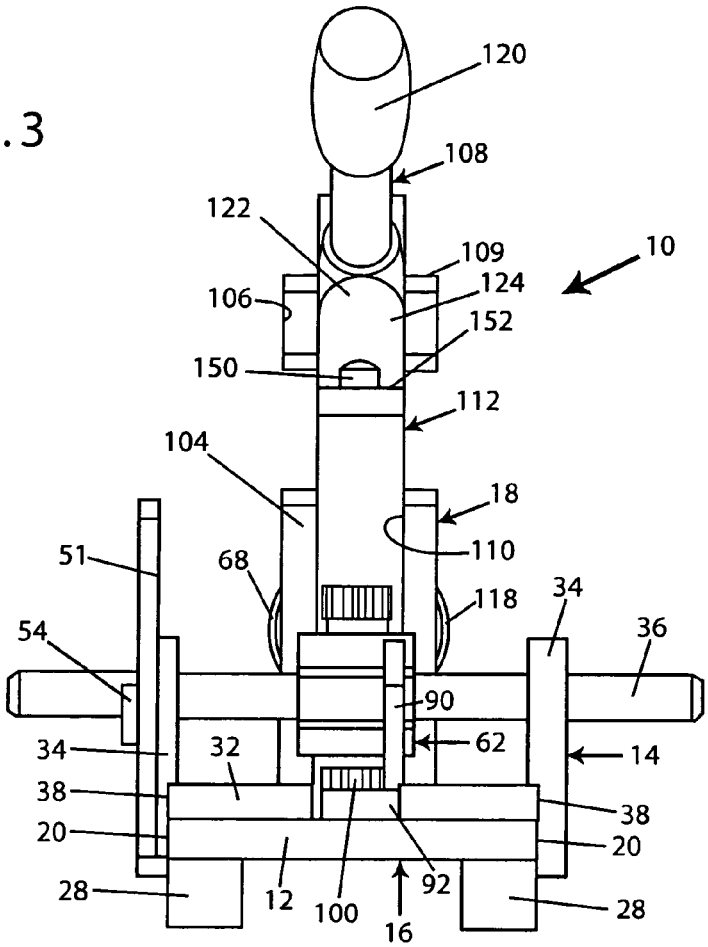
FIG. 3 is a rear elevation view of the key-duplicating machine of FIG. 1.

As shown in FIGS. 1, 2 and 4, cutting block assembly 18 is located at the front end of base plate 12 and includes an anchor block 104 which is affixed to upper surface 24 of base plate 12 using an appropriate fastener (not shown). An upper end 109 of anchor block 104 includes a handle-channel 106. A plunger handle 108 is pivotally attached to anchor block 104 within handle-channel 106. Anchor block 104 further includes a cartridge-receiving channel 110, as shown in FIG. 4. Cartridge-receiving channel 110 is sized and shaped to snugly receive a cutting cartridge 112, described in greater detail below. As shown in FIG. 4, cartridge 112 may be snugly positioned within channel 110 and secured into a cutting position against anchor block 104 using a bolt 114 that is positioned through a bore 116 of anchor block 104 and preferably includes a hand-operative knob 118. In this arrangement, an operator may easily remove and secure any one of several cutting cartridges 112, depending on the type and brand of key being cut, as described below.

Plunger handle 108 is pivotally attached to upper end 109 of anchor block 104, as shown in FIG. 4, at pivot point 119 and is pivotal from a compressed position, generally shown in FIG. 4, wherein the cutter assembly has completed its cutting stroke, described below, and a fully open position, shown in FIG. 2, wherein plunger handle 108 is out of the way so that a user may easily remove cartridge 112. Plunger handle 108 includes a handle portion 120 and a pivot support portion 122. Pivot support portion 122 is preferably made from a strong rigid material and includes a contact surface 124.

Referring to FIGS. 1, 4, 8, and 12A, cutting cartridge 112 includes a block-frame 126 having an open channel 128 and an intersecting bore 130. A cutter pin 132 is sized and shaped to slidingly fit within bore 130 between a resting position (shown in FIG. 4) and a fully cut position. Cutter pin 132 includes a guide section 134 which is aligned with open channel 128 so that it is exposed and accessible to the user. Guide section 134 is generally triangular in section with the apex 135 of the triangle facing towards the rear of the base plate 12. Cutter pin 132 further includes a cutting nib section 136 which is positioned just below the shaped guide section 134 so that the shape of the eventual cut matches the shape of the guide section 134. Cutting nib section 136 includes an angled cutting edge 138, shown in FIG. 8. A cutting support surface 140 is formed at the lower end of open channel 128 and is used to support the key blank during the cutting process, as described below in greater detail. Cutter pin 132 is designed to move a sufficient distance to ensure that cutting edge 138 extends equal to or preferably slightly below support surface 140.

Cutter pin 132 is designed to be moved from a resting position to a depressed cutting position. To provide the required spring bias to keep cutter pin 132 in its resting raised position, shown in FIG. 8, a spring 142 is provided about an upper portion of cutter pin 132 and is located within a spring bore 144 (axially aligned with bore 130). Located adjacent spring 142 and affixed through cutter pin 132 is a spring pin 146. Spring pin 146 passes generally perpendicularly to the longitudinal axis of cutter pin 138 and extends a prescribed distance beyond the cutter pin 132 on either side, as shown in FIG. 8. Spring 142 is a compression type spring and pushes against a lower section of spring bore 144 and against spring pin 146 in a known and understood manner to bias cutter pin 132 to a raised position, as shown in FIG. 8. Elongated cross-slots 148 are provided within block-frame 126 of cutting cartridge 112 on opposing sides of spring bore 144 to receive the extended portions of spring pin 146 and provide for its movement as cutter pin 132 moves its full range. Also, engagement of spring pin 146 with elongated cross slots 148 ensures that the entire cutter pin 132 remains aligned and moves in predictable manner during its entire range of movement.

As shown in FIG. 8, cutter pin 132 is supported in bore 130 at both sides of open channel 128 to ensure that cutter pin 132 remains aligned and supported, so that each cut made into the key blank is accurate and predictable.

Cutter pin 132 includes a contact portion 150 which extends beyond an upper section 152 of block-frame 128. Contact portion 150 is designed to be contacted and depressed by contact surface 124 of plunger handle 108.

Figure 13:
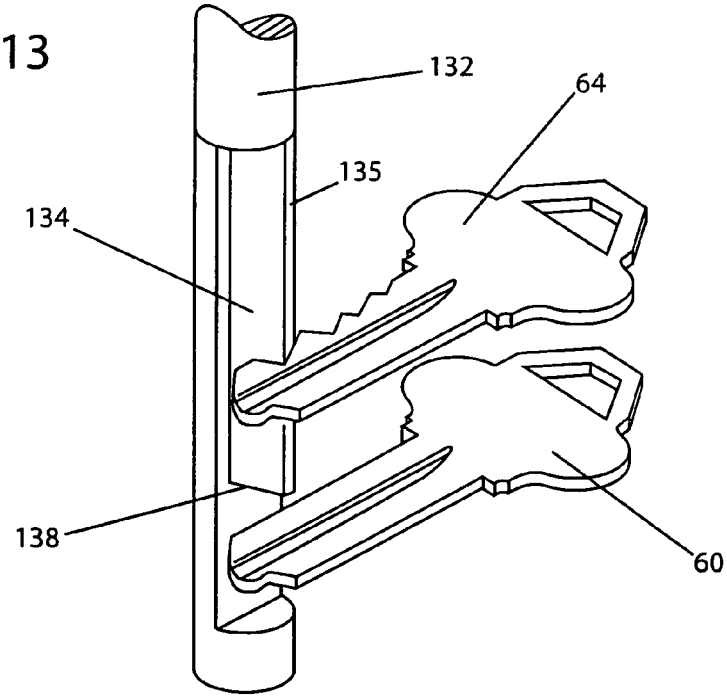
FIG. 13 is a perspective view showing the relative positions of a key master and a key blank with respect to the cutter pin.

Referring to FIG. 13, the relative cutting position of a held key blank 66 and a held and aligned key master 64 is shown with respect to cutter pin 132. The figure shows how apex 135 of guide section 134 of cutter pin 132 fits snugly into each bitting or notch of key master and in doing so, automatically and correctly positions the held key blank 66. When cutter pin 132 is depressed, as described below, cutting edge 138 engages key blank 66 and cuts a corresponding notch into key blank 66.

Operation

In operation, a user first determines the type and size of key to be cut by referring to appropriate known charts. The user then selects an appropriate key blank 66 and an appropriate cutter cartridge 112. Once selected, the cutter cartridge 112 is inserted and seated within channel 110 and held in position by tightening knob 118. Once tightened within channel 110, cutter cartridge 112 is automatically aligned and ready to cut keys. Handle 108 may be pivoted to its fully open position, as shown in FIG. 2, to provide more access to channel 110 during insertion of cutter cartridge 112, if necessary.

Once the cutter cartridge is positioned within channel 110, the user then positions the key-clamping assembly 62 so that it faces towards the key-reference block 16 (as shown in FIG. 1) by pivoting the key-clamping assembly 62 and transverse support pin 36 within bores 60 of side support plates 34. When the key-clamping assembly 62 is in this rearwardly facing position, the user mounts a key master 64 into the lower clamp of key-clamping assembly 62 (with its "teeth" facing away from the clamp) by positioning key 64 within channel 78 and rotating knob 86 and fastener 84 to tighten clamping plate 80 against key 64, holding it within channel 78. The user then places an appropriate key blank 66 in a similar manner into the upper key clamp with "teeth" portion (portion to be cut) facing away from the clamp.

Figure 12A:
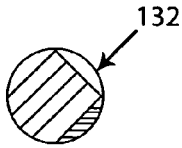
FIG. 12A is an enlarged horizontal cross-section view of the cutter pin.
Figure 12:
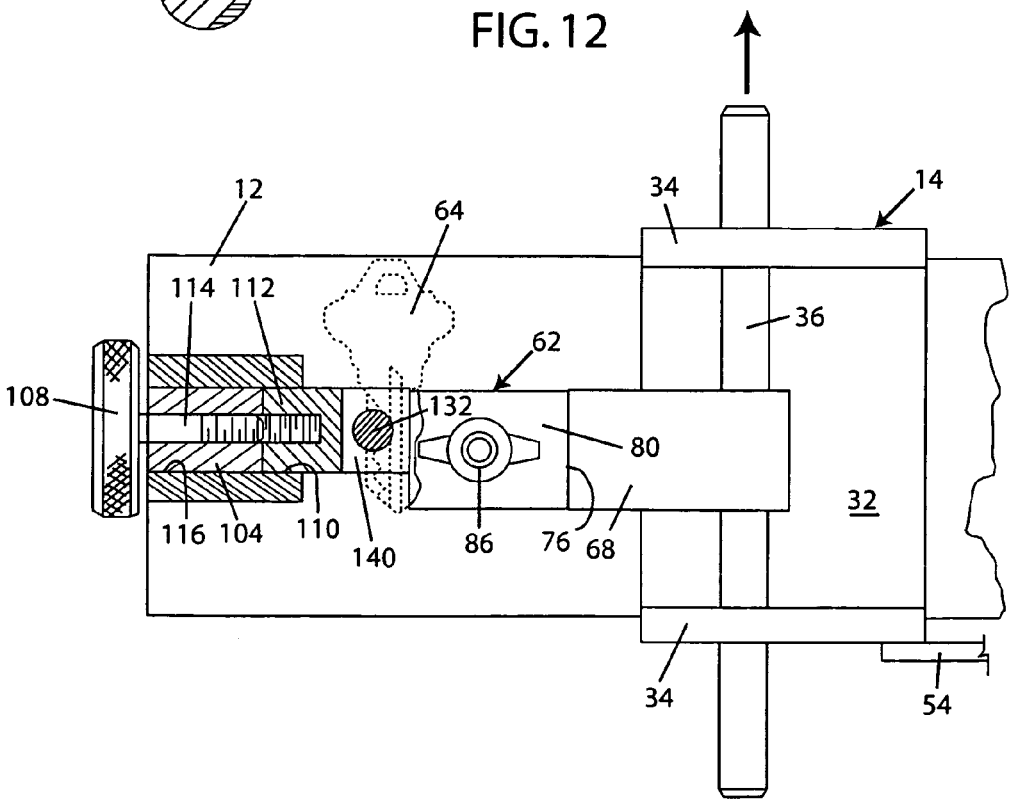
FIG. 12 is a top plan view partially in section of a portion of the key-duplicating machine of FIG. 1, showing details of the key-clamp assembly located in a cutting position.

To ensure that both keys are transversely aligned (with respect to the longitudinal axis of base plate 12), both key master 64 and key blank 66 are positioned so that their respective shoulders abut against a respective portion of clamp block 68, as shown in FIG. 12.

The user has already adjusted reference set up block 16 to an appropriate position by loosening fastener 100 and sliding the base portion 92 along slot 94. The appropriate position will depend on the type and size of key being cut, but for the most part, one location of the reference set-up block 16 will be appropriate for a majority of key types and sizes.

The user then pushes down on key-movement handle 51 so that slider block 14 is drawn rearwardly and so that the clamped keys 64, 66 are both advanced towards reference block 16. The user lightly forces both held keys into contact with vertical portion 90 of reference block 16 to ensure that both held keys are aligned with respect to each other as they are held in their respective clamps of key-clamping assembly 62. Key clamps may be adjusted if necessary and the keys moved until they both align longitudinally as well.

When both key master 64 and key blank 66 are correctly mounted within their respective lower and upper channels of clamp block 68, the entire key-clamping assembly 62 (including fixed transverse support pin 36) is pivoted within bores 60 of slider block 14 so that the clamped keys 64, 66 face forward and lie adjacent to cutting block assembly 18, as shown in FIGS. 10 and 12. Owing to the function of slider block 14 and springs 48, it will be necessary for the user to simultaneously push down on key-movement handle 51 so that slider block 14 moves away from the cutter cartridge 112 as the clamp block 62 is pivoted from a rearwardly facing position to a forward-facing position. This is required so that the keys 64, 66 clear the cutting assembly and are allowed to settle in a proper cutting position with respect to cutter cartridge 122, as shown in FIGS. 10 and 12. Once the clamped keys 64, 66 are facing and are adjacent to the cutter cartridge 112, the user manipulates the key-movement handle 51 and the transverse support pin 36 to control the relative position of the keys with respect to the cutter pin 132. The user moves the key master 64 along the guide section 134 until a particular notch of the key master 64 engages the guide section 134. When this occurs, the user merely releases key-movement handle 51 so that springs 48 biases slider block 14 (and therefore key master 64) into tight engagement with guide section 134 of cutter pin 132. When apex 135 of guide section 134 rests within the "valley" of the particular notch of key master 64, the user may operate the cutter to cut a matching notch into the adjacent key blank 66.

To operate the cutter, the user pushes down on plunger handle 108 so that the contact surface 124 presses directly down on contact portion of cutter pin 132. As cutter pin 132 advances downwardly, angled cutting edge 138 forces the matching aligned portion of key blank 66 between it and the support surface 140. This interaction is similar to a tool and die press. Eventually, sufficient force is applied to cut a notch in the relatively soft metal key blank 66. Spring pin 146 ensures that cutter pin 132 returns to its home, rest position above the key master and key blank. Spring pin 146 preferably is strong enough to assist in lifting handle 108 as well.

Once the notch is cut, the user moves apex 135 of guide section 134 to the next notch detail of key master 64 and the process is repeated until the exact notch arrangement of key master is reproduced on the key blank 66.

Once all notches of key master 64 are reproduced onto key blank 66, the duplication process is complete and the keys are removed from clamp assembly by loosening knobs 86.

What is claimed is:

1. A duplicating machine for cutting a key blank from the notch-profile of a master key; said duplicating machine comprising:

a frame having a cutting end and an alignment end, said frame including a longitudinal axis;

a carriage movable along said longitudinal axis and including a transverse axis;

a key clamping assembly having a first key clamp for holding said key blank and a second key clamp for holding said master key, said key clamping assembly being slidable along said transverse axis, a cutter assembly located at said cutting end, said cutter assembly including a punch-type cutter pin that is adapted to selectively cut pre-shaped notches from said held key blank, said cutter pin including a guide section that aligns with said notch-profile of said held master key; and said key clamping assembly being rotatable about said transverse axis and with respect to said carriage so that said mounted keys face either said cutting end or said alignment end of said frame.

2. The duplicating machine, according to claim 1, wherein said frame includes at least one longitudinal slot and a pin attached to said cartridge, said pin being slidable within said slot and defining a range of motion for said carriage.

3. The duplicating machine, according to claim 1, wherein said carriage is biased towards said cutting end of said frame.

4. The duplicating machine, according to claim 2, wherein said bias is created by a spring attached between said carriage and said frame.

5. A duplicating machine for cutting a key blank from the notch-profile of a master key; said duplicating machine comprising:

a frame having a cutting end and an alignment end, said frame including a longitudinal axis;

a carriage mounted on said frame and movable along said longitudinal axis;

a key clamping assembly for holding said key blank and said master key, said key clamping assembly being mounted on said carriage;

a cutter assembly located at said cutting end of said frame, said cutter assembly including a punch-type cutter pin that is adapted to cut notches of predetermined shape from said held key blank, said cutter pin including a guide section that aligns with the notch-profile of said held master key; wherein said key clamping assembly is rotatable with respect to said carriage so that said clamped keys can be positioned to face either the cutting end or the alignment end of said frame.

6. The duplicating machine, according to claim 5, wherein said key clamping assembly is movable with respect to said cutter assembly so as to cut spaced notches from said held key blank.

7. The duplicating machine, according to claim 5, wherein said key clamping assembly includes a horizontal pin which is rotably supported by said carriage.

8. The duplicating machine, according to claim 6, wherein said key clamping assembly includes a horizontal pin which is rotably supported by said carriage.

* * * * *